US007249946B2

(12) United States Patent
Martin et al.

(10) Patent No.: US 7,249,946 B2
(45) Date of Patent: Jul. 31, 2007

(54) THERMAL GENERATOR AND COMBUSTION METHOD FOR LIMITING NITROGEN OXIDES EMISSIONS BY RE-COMBUSTION OF FUMES

(75) Inventors: Gérard Martin, Saint Genis Laval (FR); Willy Nastoll, Les Roches de Condrieu (FR); John Roesler, Rueil Malmaison (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 335 days.

(21) Appl. No.: 10/479,139

(22) PCT Filed: May 23, 2002

(86) PCT No.: PCT/FR02/01749

§ 371 (c)(1),
(2), (4) Date: Nov. 28, 2003

(87) PCT Pub. No.: WO02/097327

PCT Pub. Date: Dec. 5, 2002

(65) Prior Publication Data

US 2004/0161716 A1 Aug. 19, 2004

(30) Foreign Application Priority Data

May 30, 2001 (FR) ..... 01 07116

(51) Int. Cl.

| | |
|---|---|
| ***F23C 6/04*** | (2006.01) |
| ***F23C 5/02*** | (2006.01) |
| ***F23C 5/08*** | (2006.01) |
| ***F23C 5/00*** | (2006.01) |

(52) U.S. Cl. ..... 431/5; 431/8; 431/10; 431/350; 431/353; 110/210; 110/212

(58) Field of Classification Search ..... 431/4, 431/8, 10, 154, 170, 174, 175, 353, 351, 431/350, 5; 110/208, 210–214, 262, 348; 60/732, 733

See application file for complete search history.

(56) References Cited

U.S. PATENT DOCUMENTS 2,483,737 A * 10/1949 Parrish ..... 431/190

(Continued)

FOREIGN PATENT DOCUMENTS

JP 54105328 8/1979

(Continued)

OTHER PUBLICATIONS

Patent Abstracts of Japan, vol. 007, No. 059 (M-199), Mar. 11, 1983 & JP 57204709 A (Takuma Sougou Kenkyusho) Dec. 15, 1982.

Patent Abstracts of Japan, vol. 005, No. 174 (M-096_Nov. 10, 1981 & JP 56 100211 A (Nippon Kokan) Aug. 12, 1981.

*Primary Examiner*—Carl D. Price
(74) *Attorney, Agent, or Firm*—Antonelli, Terry, Stout & Kraus, LLP.

(57) ABSTRACT

The invention relates to a thermal generator comprising a furnace tube (2) wherein a fuel is burnt, recombustion means (14, 15) for reducing the nitrogen oxides content present in said fumes and means (3) for recovering the heat of the fumes resulting from said combustion. The invention is characterized in that recombustion means (14, 15) are arranged in containment means (11).

24 Claims, 1 Drawing Sheet

U.S. PATENT DOCUMENTS

Figure 1:
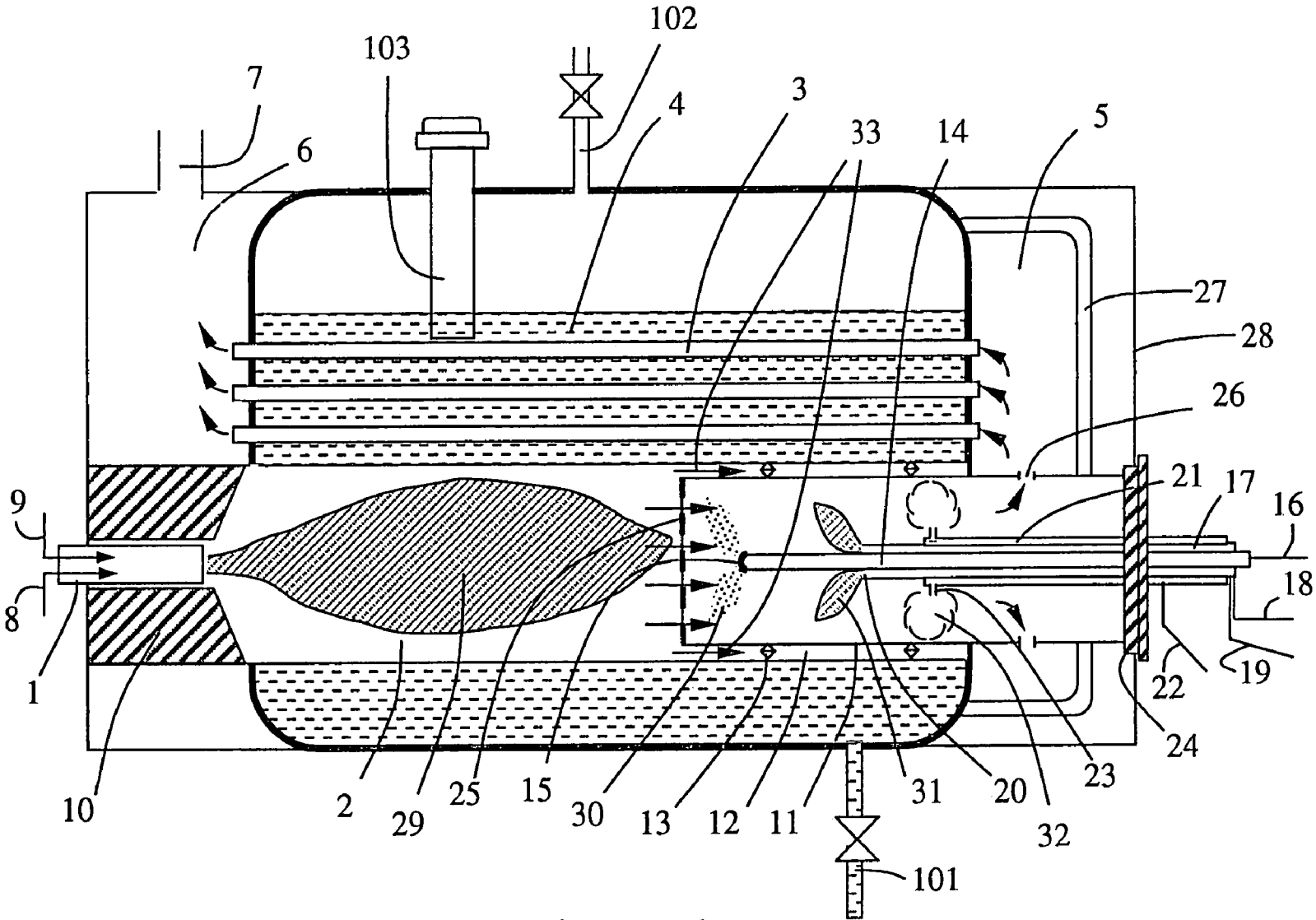

| | | | | | |
|---|---|---|---|---|---|
| 2,999,359 | A | * | 9/1961 | Murray | 60/733 |
| 3,680,501 | A | * | 8/1972 | Szilagyi et al. | 110/212 |
| 3,951,082 | A | * | 4/1976 | Leggett et al. | 110/211 |
| 4,038,022 | A | * | 7/1977 | Blackman | 431/166 |
| 4,044,099 | A | * | 8/1977 | Griffin | 423/210 |
| 4,329,932 | A | * | 5/1982 | Takahashi et al. | 110/347 |
| 4,389,848 | A | * | 6/1983 | Markowski et al. | 60/738 |
| 4,395,223 | A | * | 7/1983 | Okigami et al. | 431/10 |
| 4,823,710 | A | * | 4/1989 | Garrido et al. | 110/234 |
| 4,862,835 | A | * | 9/1989 | Oppenberg | 122/17.2 |
| 5,009,589 | A | * | 4/1991 | Shekleton et al. | 431/183 |
| 5,024,058 | A | * | 6/1991 | Shekleton et al. | 60/752 |
| 5,078,064 | A | * | 1/1992 | Breen et al. | 110/212 |
| 5,102,330 | A | * | 4/1992 | Ho | 432/14 |
| 5,139,755 | A | | 8/1992 | Seeker et al. | |
| 5,645,410 | A | * | 7/1997 | Brostmeyer | 431/10 |
| 5,725,366 | A | * | 3/1998 | Khinkis et al. | 431/10 |
| 6,109,911 | A | * | 8/2000 | Tamminen et al. | 431/4 |
| 6,206,685 | B1 | * | 3/2001 | Zamansky et al. | 431/4 |
| 6,287,111 | B1 | | 9/2001 | Gensler | |
| 6,481,998 | B2 | * | 11/2002 | Payne et al. | 431/5 |

FOREIGN PATENT DOCUMENTS

| | | | |
|---|---|---|---|
| JP | 57-47108 | * | 3/1982 |
| JP | 57-204709 | * | 12/1982 |
| JP | 58-187712 | * | 11/1983 |
| JP | 59-185908 | * | 10/1984 |
| WO | WO 97/25134 | | 7/1997 |

* cited by examiner

THERMAL GENERATOR AND COMBUSTION METHOD FOR LIMITING NITROGEN OXIDES EMISSIONS BY RE-COMBUSTION OF FUMES

FIELD OF THE INVENTION

The present invention relates to the sphere of thermal generators, notably industrial boilers, allowing to limit nitrogen oxides emissions by recombustion of the fumes and to a method for implementing such a generator.

The invention is applicable to any type of boiler such as, for example, fume-tube boilers, water-tube boilers, ambitubular boilers, and it can be implemented whatever the thermal power of said boiler.

BACKGROUND OF THE INVENTION

There are well-known methods for recombustion of the fumes discharged so as to reduce the $NO_x$ emissions, such as those described in patents U.S. Pat. No. 5,139,755 and WO97/25,134.

This recombustion is a nitrogen oxides reduction technique based on stepping of the combustion. A furnace usually contained in these boilers, wherein this technique is used, comprises three zones:

the first zone wherein about 85 to 95% by mass of the fuel is burnt under standard conditions, i.e. with about 5 to 15% excess air when gaseous fuels or liquid fuels are used;

in the second zone, downstream from the first zone, the remaining fuel which consumes the excess oxygen of the fumes from the first zone is injected. The atmosphere of this second zone becomes reducing and the nitrogen oxides generated in the first zone are essentially converted to molecular nitrogen under the action of hydrocarbon-containing radicals;

in a third zone (or postcombustion zone), air is added so as to eliminate all the unburnt substances generated in the second zone and to have a standard excess air of 5 to 15% at the outlet.

The recombustion method described above generally allows to decrease the $NO_x$ emissions by about 50 to 80%.

Although in its principle recombustion is attractive as regards performances and insofar as it requires no reactant allowing to reduce the nitrogen oxides other than the fuel itself, it however presents considerable drawbacks.

In the case of a thermal generator working with natural gas, the most significant difficulties encountered are:

high corrosion in the recombustion zone and in the postcombustion zone, due to the presence of a reducing atmosphere or to alternating oxidizing and reducing atmospheres, imperfect oxidation of the recombustion fuel in the postcombustion zone and, as a consequence, formation of gaseous and solid unburnt residues and, in the most severe cases, fouling of the downstream exchange surfaces, which reduces the overall energy efficiency and requires more sophisticated and expensive automatic cleaning equipments, safety difficult to provide because of the stage of injection of a fuel in the recombustion zone. The main risk is a non-combustion of said fuel owing to an operating trouble or to an ill-controlled transient operation. In this case, there are risks of explosion in the parts situated downstream from the recombustion zone (recovery boiler, filter, etc.).

In the case of a thermal generator working with heavy petroleum products, the implementation difficulties are the same as those encountered with natural gas, but they are often increased for some of them. This is in particular the case for solid unburnt residues produced in larger quantities. Furthermore, the denitrification efficiency can be lower with these heavy products because of the presence of nitrogen-containing compounds in the initial fuel.

SUMMARY OF THE INVENTION

The present invention aims to overcome the aforementioned drawbacks by means of a thermal generator comprising a furnace tube wherein a fuel is burnt, recombustion means allowing to reduce the nitrogen oxides content present in said fumes, and means for recovering the heat of the fumes from said combustion, characterized in that it comprises containment means wherein said recombustion means are arranged.

Advantageously, the containment means are arranged between the furnace tube and the heat recovery means.

Said containment means can be extractable and fastened to a trap door.

Preferably, the containment means can include means allowing to modify the velocity profile of the fumes at the inlet of said containment means.

Advantageously, a fume box can be arranged between the containment means and said heat recovery means.

Said fume box can comprise tubes for heat exchange with the fumes.

Preferably, said containment means can include a shell wherein means for injecting a recombustion fuel and means for generating a pilot flame are successively arranged, in the direction of circulation of the flames.

Said containment means can also comprise means for injecting air intended for postcombustion.

The pilot flame can be positioned substantially halfway between the postcombustion air injection point and the recombustion fuel injection point.

Besides, means for injecting air intended for postcombustion can be arranged downstream from said shell.

The invention also relates to a method for limiting nitrogen oxides emissions discharged by a thermal generator, characterized in that the following stages are carried out:

a) burning a major part of the fuel in a combustion zone, b) passing the fumes resulting from said combustion into a containment zone (11), c) mixing in said containment zone a minor part of the fuel with said fumes.

According to a preferred embodiment, air can be injected into the fumes resulting from stage c) during a stage d)., According to another variant, stage d) can be carried out in said containment zone.

According to another embodiment, about 70% to about 95% of the total fuel mass can be burnt during stage a), about 5% to about 30% of the total fuel mass can be burnt during stage c) and an amount of air allowing to have excess air in relation to stoichiometric conditions of about 5% to about 25% can be injected during stage d).

The fumes from stage c) can be contacted with a pilot flame prior to stage d).

A chemical reactant other than the fuel can be added to the air injected during stage d) to allow reduction of the nitrogen oxides by selective non-catalytic means.

According to an advantageous embodiment, when the generator works under reduced operating conditions, the flow rates of the fuel injected in the combustion zone and in the containment zone can be adjusted so as to maintain a substantially constant temperature in said containment zone.

The invention thus provides a simple, efficient and safe solution for recombustion of boiler fumes allowing to significantly reduce emissions of pollutants and in particular of nitrogen oxides ($NO_x$).

The device and/or the method according to the invention advantageously allows to reduce nitrogen oxides discharges by 30% to 90%, preferably by 50% to 75% in industrial boilers whose power generally ranges between 100 kWth (thermal kilowatts) and 50 MWth (thermal megawatts) without requiring costly and sophisticated equipments since they are limited to a shell and to fuel and oxidizer injection means.

Furthermore, this mode of reducing nitrogen oxides emissions does not require other <<reactants>> than the fuels used by the boiler.

The solution provided is all the more interesting as it is often difficult, or even impossible, to install known specific burners that produce only small amounts of nitrogen oxides (also referred to as low-$NO_x$ burners) in confined furnaces such as those encountered in fume-tube boilers or flash boilers. The solution provided by the present invention can also be applied to existing boilers, with minor changes brought to the fumes box that connects the furnace tube to the fumes tubes.

By means of the invention, recombustion is carried out under optimum conditions insofar as the flow of the fumes to be processed is homogeneous in temperature and concentration, and as it is possible to inject the recombustion fuel and the postcombustion air under optimum conditions as regards mixing.

Furthermore, this recombustion is carried out without any risk for the furnace tube, which is a sensitive part of the boiler, and the containment means (a shell for example) form a screen that protects said furnace tube from possible corrosion and/or carbon deposition risks. Finally, the furnace tube is never in contact with reducing gases and/or gases containing substances likely to create carbon deposits.

Furthermore, the presence of a pilot burner eliminates the possibility of having large amounts of unburnt fuel at the recombustion zone outlet and the resulting possible explosion risks in the downstream parts of the boiler.

It is also possible to provide certain inner parts of the containment means with insulating materials in order to adjust the thermal profile according to the recombustion requirements. This containment means can also be innerly coated with specific materials such as certain ceramics which limit the formation of coke.

The possible coking risks in the recombustion zone are also much more limited on the hot walls of the containment means (typically between 800 and 1100° C.) than on walls provided with membranes such as those commonly used or in the furnace tube, where the temperatures are most often limited between 250 and 400° C.

Furthermore, the presence of two fuel injection points in the furnace tube, a first point close to the main burner and a second point close to the recombustion zone, facilitates control of the heat extraction in said furnace tube, in particular under reduced operating conditions, in order to prevent too great a temperature decrease where postcombustion is to be carried out.

The solution provided advantageously allows a recombustion operation to be carried out with heavy petroleum products, which would certainly be difficult without containment means because of the fouling risk.

The device and/or the method according to the invention also allows a strategy consisting in a multistage recombustion fuel delivery, which is certainly more suitable for fuels having a certain amount of constitutional nitrogen in order to prevent the conversion of said constitutional nitrogen to $NO_x$.

It is also possible to combine a non-catalytic selective reduction operation with the recombustion operation under optimum conditions for both operations. Such a combination allows to obtain efficiencies that may exceed 90%.

According to the invention, the maintenance operations in the recombustion zone are very simple insofar as the containment means can be readily removed from the furnace tube.

The containment means of the invention have a low mass in relation to the mass of the boiler and they therefore do not bring a significant additional inertia. The start times, operating mode change or holding times are therefore not penalized.

Advantageously, the solution provided in the present application to significantly reduce the $NO_x$ emissions level in the fumes finally discharged can also be applied to boilers equipped with vertical cylindrical furnaces, whether flash boilers or not. It is also applicable to water-tube boilers having cylindrical or parallelepipedic furnaces.

BRIEF DESCRIPTION OF THE SOLE FIGURE

Other features and advantages of the present device will be clear from reading the description hereafter of a non limitative embodiment of the invention, with reference to the sole FIG. 1 which diagrammatically shows a boiler according to the invention.

DETAILED DESCRIPTION

FIG. 1 shows an industrial two-pass fumes-tube boiler including a recombustion device according to the invention but, of course, the invention is not restricted to this type of boiler configuration.

The boiler comprises a burner 1, a cylindrical furnace tube 2, fumes tubes 3 used as recovery means for the heat of the fumes resulting from combustion, a cylindrical boiler barrel 4 wherein the water to be heated and vaporized is contained, fumes boxes 5 and 6, a smokestack 7, a water inlet 101, a steam outlet 102 and a device 103 intended for water level control in said boiler barrel 4.

Burner 1 is supplied, through line 8, with a gaseous or liquid fuel and with an oxidizer, here in form of a gas which may be air, through line 9. This burner is placed in a quarl 10 and it produces a flame 29 which develops in furnace tube 2 of substantially cylindrical shape and heats the water present around this furnace tube.

Furnace tube 2 is designed in such a way that, at full power, the flame does not occupy the total length thereof and leaves, in the downstream part in relation to the direction of the gaseous flow, a free space that corresponds for example to a third of the total volume of said furnace tube.

The layout described above is conventionally used in the prior art in the case of a two-pass industrial boiler (*Techniques de l'ingénieur*, BE2, B1480-5 (1998)).

According to the invention, containment means, in form of a substantially cylindrical shell 11, are arranged in the downstream part of furnace tube 2. This shell is the place where the fumes coming from burner 1 will flow and where recombustion and possibly postcombustion of said fumes is carried out. The outside diameter of the shell is slightly smaller than the inside diameter of the furnace tube so as to create a passage 12 between said shell and said furnace tube. This passage has to be minimized by means of any known technique so as to allow a minor fraction of the fumes to flow therethrough, but it has to be sufficient to allow the shell to be taken off through a trap door 24. The section of passage 12 represents 0.1 to 10% of the total section of flow of said furnace tube, preferably 2 to 5%. Said shell can be simply laid in the furnace tube on support elements 13, but other fastening means known to the man skilled in the art are also possible.

Several fuel and oxidizer injection means are arranged inside shell 11, preferably at the center thereof. These means can be concentric as shown in FIG. 1, with a first central pipe 14 comprising, at the end 15 thereof, mechanical or pneumatic spraying means for injecting recombustion fuel 30 delivered through a line 16, then, in the direction of the periphery, a concentric pipe 17 supplied with fuel and oxidizer through lines 18 and 19, used to create at the end 20 thereof an annular pilot flame 31, either multipoint or single, and finally a last concentric pipe 21 supplied with air through a line 22 and allowing to inject postcombustion air 32 introduced through calibrated orifices 23 for example.

These fuel and oxidizer injection means are for example fastened to a trap door 24. They can be dimensioned as it is known in the art so that they are cooled only by means of the fuel, the oxidizer and possibly the carrier fluids they convey, but they can also be cooled by an auxiliary fluid circulating in jackets (not shown in FIG. 1).

Shell 11 can possibly comprise, in the upstream part thereof (in relation to the direction of flow of the fumes), means 25 intended to modify the velocity profile of the fumes at the inlet of said shell. These means include, for example, a grate or a perforated plate. The geometry of these means is defined by the man skilled in the art so as to obtain, in combination with the means used for injecting the recombustion fuel, very fast and very homogeneous dispersion of said recombustion fuel in the fumes stream to be processed. Means 25 can also serve as a thermal screen and protect the recombustion fuel and postcombustion air injection means from too great a radiation of the flame. Means 25 can also be used to homogenize the temperature in shell 11.

Pilot flame 31 is positioned between recombustion fuel injection point 30 and postcombustion air injection point 32, and preferably substantially halfway between these two points.

Shell 11 is provided with orifices 26 through which the processed fumes flow out prior to entering fumes box 5, then fumes tubes 3.

According to another embodiment, shell 11 can be entirely open in the downstream part thereof (which opens into fumes box 5).

Without departing from the scope of the invention, it is also possible for the shell to house only the recombustion zone, the postcombustion operation being carried out in the fumes box and the postcombustion air being introduced from the walls of said fumes box, and not from a central pipe.

The fumes box can have refractory walls or it can be provided, partly or totally, with exchanger tubes 27 connected or not to boiler barrel 4 according to an embodiment similar or equivalent to the embodiment described in <<*Les techniques de l'ingénieur*, BE2, B1480-7 >>. On the rear part 28 of the boiler, the exchanger tubes can be partly off-center in order to leave a free passage for the shell so that it can be readily removed from the boiler if necessary.

Shell 11 consists of refractory metal materials. It can be innerly coated, partly or totally, with insulating materials in order to reduce thermal exchanges with the furnace tube. For example, all or part of the shell corresponding to the recombustion zone can be coated with a thin layer of a highly insulating material such as ceramics for example, whereas the part of the shell wherein postcombustion takes place remains substantially insulant-free. The insulating materials are deposited on the walls as it is known in the art, while taking in particular account of the expansion differences between metallic parts and ceramics.

The refractory coating of the recombustion zone can also be selected so as to limit the formation of coke, in particular when heavy petroleum fuels likely to generate large amounts of unburnt residues are used.

When nitrogen-containing fuels are used as recombustion fuel, said recombustion fuel is preferably injected in two (or more) stages: a first injection immediately at the shell inlet, and a second injection approximately halfway between the first recombustion fuel delivery point and the postcombustion air injection point. The flow rate of the recombustion fuel injected at the first point is calculated so as to consume all of the residual oxygen from the main combustion zone, without creating a really fuel-rich zone. The second injection is on the contrary aimed to create a really fuel-rich zone in the second part of the recombustion zone.

Burner 1 uses, for example, natural gas or heavy fuel oil, or petroleum residues, or any type of fuel used by industrial fume-tube boilers. It is generally a conventional burner which generates a compact flame and with which it is difficult to develop nitrogen oxides reduction strategies in the burner. In fact, the most commonly used furnace tubes are too narrow to receive low nitrogen oxides emission burners because they generate most often very developed flames.

Burner 1 can have a means for driving the oxidizer gas into partial or total rotation (not shown in FIG. 1) so as to have fumes circulation currents at the furnace tube outlet, rather localized in the neighborhood of the wall of said furnace tube, and thus to facilitate the flow of a minor part of the fumes in space 12 in the direction shown in FIG. 1.

According to another embodiment and operating mode, burner 1 and the oxidizer injection means can be designed to favor a great axial impetus of the oxidizer so as to create recirculation currents along the walls of the furnace tube. Under these conditions, the direction of circulation of the fumes in space 12 is opposite to the direction shown by arrows 33 in FIG. 1. A fraction of the fumes present in fumes box 5 could thus be recycled upstream from shell 11. The interest of this operating mode is that the whole of the fumes can be processed by recombustion, whereas in the mode mentioned above (burner with means for driving the oxidizer in a rotating motion), the fraction of the fumes circulating in space 12 is not subjected to recombustion.

The excess air at the burner in relation to stoichiometry is adjusted so as to typically range between 5 and 25%.

The position of shell 11 in furnace tube 2 is determined in such a way that the temperature of the fumes at the inlet of said shell under nominal running conditions ranges between 1100 and 800° C., preferably between 1000 and 900° C. The amount of recombustion fuel fed into the shell ranges between 5 and 30% of the total fuel consumed by the boiler, preferably between 10 and 15%. The fuel used by the pilot flame typically consumes only 1% of the total fuel. The flow rate of the postcombustion air is calculated in such a way that the excess air at the shell outlet ranges between 5 and 25%.

The assembly for mixing the recombustion fuel with the fumes to be processed, consisting of means 25 and of injection device 15, is dimensioned by means of any technique known to the man skilled in the art so that said mixture is obtained in less than 100 ms. In the case of a gaseous recombustion fuel, injection can be carried out from a single head provided with a sufficient number of orifices, as shown in FIG. 1, but other injection modes are also possible at the level of one or more rings whose diameter is larger than the diameter of pipe 14. In the case of a liquid recombustion fuel, the injection head is calculated as it is known in the art in such a way that the grain size distribution and the initial velocities of the droplets provide complete and homogeneous covering of the fumes stream to be processed, without contact of the non totally vaporized droplets with the inner wall of shell 11.

The residence time of the fumes between the recombustion fuel injection point and the postcombustion air injection point ranges between 100 and 500 ms, preferably between 150 and 200 ms.

The purpose of pilot flame 31 is to provide combustion of the recombustion fuel if the temperature at the inlet of the recombustion zone drops suddenly due to an operating trouble or to an ill-controlled transient operation. The function of pilot flame 31 is essentially a safety function and there is generally no question of permanently maintaining a recombustion operation wherein the recombustion fuel would not be partly or totally oxidized before the pilot burner. A temperature probe, not shown in FIG. 1, is placed on pipe 14, with one or more measuring points between end 15 of said pipe 14 and end 20 of pipe 17. According to a procedure example, when the temperature measured at this or these point(s) is below a set value, for example between 500 and 1000° C., preferably between 800 and 900° C., the recombustion operation is immediately stopped.

The postcombustion air delivery device is calculated as it is known in the art, in such a way that the mixing time of said postcombustion air with the gases from the recombustion zone is less than 100 ms. Additional means, not shown in FIG. 1, such as a venturi or a diaphragm, can be arranged before or at the same level as the postcombustion air injection point(s), so as to favor mixing of said postcombustion air with the gases from the recombustion zone.

The postcombustion air possibly contains additives in form of reactants such as ammonia or urea, or other compounds with equivalent effects, in order to add a non-catalytic selective nitrogen oxides reduction to the postcombustion operation proper.

The recombustion fuel is fed into the shell once the following operations have been carried out:

Firing and power build-up of main burner 1,

Firing of pilot flame 31,

Postcombustion air delivery 32.

To stop the boiler, the same operations are performed, but in the reverse order.

During operating variations of the boiler, the device is adjusted so as to maintain a substantially constant temperature after injection of the recombustion fuel. For example, when the power of the boiler is reduced by half, it is possible, according to a first embodiment, to decrease the fuel flow rates in the main burner and in the recombustion zone in the same proportions. However, this approach has the drawback of decreasing the temperature at the shell inlet and therefore in the recombustion zone, with risks of significant decrease in the nitrogen oxides reduction efficiency. A second embodiment of the invention advantageously uses a strategy which consists in reducing more significantly the flow rate in the vicinity of the main burner and in increasing the recombustion fuel flow rate, the sum of these two flow rates being identical to the flow rate normally required for partial running conditions. This procedure reduces thermal exchanges in the upstream part of the furnace tube. This transient phase management mode advantageously allows to keep a substantially constant thermal level in the downstream part of said furnace tube and therefore a substantially constant $NO_x$ reduction efficiency.

According to another embodiment of the invention, the thermal profile in furnace tube 2 during running variations of the boiler can also be adjusted by displacing the recombustion fuel and postcombustion air injection assembly along the principal axis of shell 11. This procedure allows to change the amount of heat extracted in the furnace tube.

The invention claimed is:

1. A method of limiting nitrogen oxides emissions discharged by a thermal generator, characterized in that the following stages are carried out:

a) burning a major part of the fuel in a combustion zone, b) passing the fumes resulting from said combustion into a containment zone separate from said combustion zone, c) mixing in said containment zone a minor part of the fuel with said fumes, and d) injecting air into the fumes resulting from stage c), wherein the fumes from stage c) are contacted with a pilot flame prior to stage d).

2. A method as claimed in claim 1, wherein stage d) is carried out in said containment zone.

3. A method as claimed in claim 1, wherein about 70 % to about 95% of the total fuel mass is burnt during stage a), about 5% to about 30% of the total fuel mass is burnt during stage c) and an amount of air injected in stage d) is sufficient to have excess air in relation to stoichiometric conditions of about 5% to about 25%.

4. A method as claimed in claim 1, wherein a chemical reactant other than the fuel allowing reduction of the nitrogen oxides by non-catalytic selective means is added to the air injected during stage d).

5. A method as claimed in claim 1, wherein, when the generator works under reduced operating conditions, the flow rates of the fuel injected in the combustion zone and in the containment zone are adjusted so as to maintain a substantially constant temperature in said containment zone.

6. A thermal generator comprising a furnace tube having a combustion zone in which combustion of a fuel takes place to generate fumes, a recombustion fuel injectors for injecting recombustion fuel to reduce the proportion of nitrogen oxides present in said fumes, at least one fumes tube for recovering the heat of the fumes resulting from said combustion, and a containment structure separate from the furnace tube in which said recombustion fuel injector for injecting recombustion fuel is arranged, wherein said containment structure includes a shell in which said recombustion fuel injector for injecting recombustion fuel and a fuel and oxidizer supply inlet for generating a pilot flame are successively arranged, in the direction of circulation of the fumes.

7. A thermal generator as claimed in claim 6, wherein said containment structure is arranged between said furnace tube and said at least one fumes tube.

8. A thermal generator as claimed in claim 6, wherein said containment structure is extractable and fastened to a trap door.

9. A thermal generator as claimed in claim 6, wherein said containment structure includes a structure selected from the group consisting of a grate, and a perforated plate for modifying the velocity profile of the fumes at the inlet of said containment structure.

10. A thermal generator as claimed in claim 6, wherein a fumes box is arranged between said containment structure and said at least one fumes tube.

11. A thermal generator as claimed in claim 10, wherein said fumes box comprises tubes for heat exchange with the fumes.

12. A thermal generator as claimed in claim 6, wherein said containment structure further include a postcombustion air injector for injecting air intended for postcombustion.

13. A thermal generator as claimed in claim 6, wherein said fuel and oxidizer supply inlet for generating a pilot flame is positioned substantially halfway between said postcombustion air injector and recombustion fuel injector.

14. A thermal generator as claimed in claim 6, wherein said postcombustion air injector is arranged downstream from said shell.

15. A thermal generator as claimed in claim 6, wherein said containment structure is provided within said furnace tube at an end thereof downstream from said combustion zone.

16. A thermal generator comprising a furnace tube in which combustion of a fuel takes place to generate fumes, recombustion means for reducing the proportion of nitrogen oxides present in said fumes, means for recovering the heat of the fumes resulting from said combustion, and containment means for containing recombustion of said fumes spaced apart from said furnace tube, wherein said containment means extending at least partly into said furnace tube and include means for modifying the velocity profile of the fumes at an inlet of said containment means, and wherein said recombustion means are arranged in said containment means.

17. A thermal generator as claimed in claim 16, wherein said containment means are arranged between said furnace tube and means for recovering the heat of the fumes.

18. A thermal generator as claimed in claim 16, wherein said containment means are extractable from said thermal generator and fastened to a trap door on a rear part of the thermal generator.

19. A thermal generator as claimed in claim 16, wherein a fumes box is arranged between said containment means and said means for recovering the heat of the fumes.

20. A thermal generator as claimed in claim 19, wherein said fumes box comprises tubes intended for heat exchange with the fumes.

21. A thermal generator as claimed in claim 16, wherein said containment means include a shell in which means for injecting a recombustion fuel and means for generating a pilot flame are successively arranged, in a direction of circulation of the fumes.

22. A thermal generator as claimed in claim 21, wherein said containment means further include means for injecting air intended for postcombustion.

23. A thermal generator as claimed in claim 21, wherein air injection means allowing postcombustion are arranged downstream from said shell.

24. A thermal generator comprising a furnace tube in which combustion of a fuel takes place to generate fumes, recombustion means for reducing the proportion of nitrogen oxides present in said fumes, means for recovering the heat of the fumes resulting from said combustion, and containment means for containing recombustion of said fumes spaced apart from said furnace tube, wherein said containment means include a shell in which means for injecting a recombustion fuel and means for generating a pilot flame are successively arranged, in a direction of circulation of the fumes, wherein said recombustion means are arranged in said containment means, and wherein said pilot flame is positioned substantially halfway between postcombustion air injection point and recombustion fuel injection point.

* * * * *